United States Patent [19]

Emmersberger

[11] Patent Number: 4,949,687

[45] Date of Patent: Aug. 21, 1990

[54] FOUR VALVE CYLINDER HEAD FOR A FOUR CYCLE ENGINE

[75] Inventor: Georg Emmersberger, Munchen, Fed. Rep. of Germany

[73] Assignee: Bayerische Motoren Werke Aktiengesellschaft, Munich, Fed. Rep. of Germany

[21] Appl. No.: 399,478

[22] PCT Filed: Dec. 14, 1988

[86] PCT No.: PCT/EP88/01151

§ 371 Date: Aug. 16, 1989

§ 102(e) Date: Aug. 16, 1989

[87] PCT Pub. No.: WO89/05910

PCT Pub. Date: Jun. 29, 1989

[30] Foreign Application Priority Data

Dec. 22, 1987 [DE] Fed. Rep. of Germany ..... 3743501

[51] Int. Cl.[5] ..... F01P 1/02; F02F 1/28; F02B 75/24; F02B 61/02

[52] U.S. Cl. ..... 123/193 H; 123/90.27; 123/90.4; 123/90.41

[58] Field of Search ..... 123/90.22, 90.27, 90.39, 123/90.4, 90.41, 41.69, 193 H

[56] References Cited

U.S. PATENT DOCUMENTS

| | | | |
|---|---|---|---|
| 3,520,286 | 7/1970 | Ravenel | 123/90.41 |
| 3,722,484 | 3/1973 | Gordini | 123/90.41 |
| 4,484,542 | 11/1984 | Krauser | 123/41.69 |
| 4,567,860 | 2/1986 | Sugiyama | 123/193 H |
| 4,686,945 | 8/1987 | Inagaki | 123/90.22 |
| 4,721,075 | 1/1988 | Kasai | 123/90.27 |
| 4,766,866 | 8/1988 | Takii et al. | 123/90.27 |
| 4,793,297 | 12/1988 | Fujii et al. | 123/193 H |
| 4,819,591 | 4/1989 | Valentine | 123/90.27 |

FOREIGN PATENT DOCUMENTS

| | | | |
|---|---|---|---|
| 1061128 | 7/1959 | Fed. Rep. of Germany . | |
| 2703520 | 8/1978 | Fed. Rep. of Germany . | |
| 1083429 | 1/1955 | France . | |
| 501573 | 3/1939 | United Kingdom | 123/90.39 |

OTHER PUBLICATIONS

Patent Abstract of Japan Bank 8NR207 JP No. 96405 date 11/82.

Technische Universitat Graz (Germany) 1983.

*Primary Examiner*—Charles J. Myhre

*Assistant Examiner*—Weilun Lo

*Attorney, Agent, or Firm*—Evenson, Wands, Edwards, Lenahan & McKeown

[57] ABSTRACT

An air-cooled single cross-flow cylinder head for motorcycle internal-combustion engines having a camshaft for valves controlling charge cycle ducts and with a scavenging direction $S_R$ aligned with the course of charge cycle ducts in the cross-flow cylinder head. The engine is provided with a relatively stiff valve drive with inlet and outlet valves and ducts arranged in planes which are essentially in parallel with respect to the scavenging direction and where the camshaft operates the valves by tappets arranged in driving connection with rocker arms in the cross-flow cylinder head.

20 Claims, 3 Drawing Sheets

FOUR VALVE CYLINDER HEAD FOR A FOUR CYCLE ENGINE

BACKGROUND AND SUMMARY OF THE INVENTION

The invention relates to an air-cooled single cross flow cylinder head motorcycle internal-combustion engines having a crankshaft pointing in the driving direction of the motorcycle ft. This camshaft controls overhead inlet and outlet through rocker arms. The engine has a scavenging direction which is approximately aligned with respect to charge cycle devices in the cylinder head and encloses an acute angle $\alpha$, with the axis of rotation of the camshaft An internal-combustion engine of this general construction is known in DE-A-No. 27 03 520. The engine therein is a flat twin engine having cross-flow cylinder heads and a camshaft arranged in each cylinder head in parallel to the crankshaft and pointing into the driving direction. Each cylinder-head comprises one inlet and outlet valve which are arranged in a plane which is in parallel to the crankshaft and rises toward the outside. The camshaft, which is in parallel to the respective valve plane, acts upon the valves through rocker arms. The inlet and outlet duct of each cylinder head is arranged relative to the respective valve plane in such a manner that a scavenging direction exists which falls from the rear top of the engine toward the front bottom and which encloses an acute angle with the axis of rotation of the camshaft.

The above-described arrangement requires a timing case which is essentially placed on the cylinder head and disadvantageously enlarges the overall dimensions of the flat twin engine and also results in a center of gravity of the internal-combustion engine which is located higher above the road surface.

Furthermore, a V-2 engine having cross-flow cylinder heads is known from Volume 31*b* of the Third Edition of "Mitteilungen des Institutes for Verbrennungskraftmaschinen und Thermodynamik" (Information of the Institute for Internal-Combustion Engines and Thermodynamics) of the Technical University of Graz from Illustrations 9.4T 2f–2g/II. The valves of this engine are arranged in planes which are essentially in parallel to the respective scavenging direction. However, here all the valves are actuated by a single camshaft, arranged between the cylinders in the engine power section, in parallel to the crankshaft. This requires a expensively constructed transmission. Here valve levers are actuated by the camshaft through relatively long push rods and rocker arms arranged in the cylinder heads for the control of the valves. Because of the relatively high oscillating masses and a high elasticity in the transmission, a precise valve control is hardly possible with acceptable expenditures. This results, in addition to unfavorable fuel consumption and exhaust values construction, in a machine with a reduced performance and rotational speed. Furthermore in this arrangement, considerable mechanical noise is created for an air-cooled engine and this also require relatively short servicing intervals for the valves due to the valve play changes.

It is the object of the invention to provide an internal-combustion engine of the above-mentioned construction, without the above-mentioned disadvantages. The invention allows for a relatively stiff valve control in a small installation space. Here several identical valves are arranged in an area of the cross-flow cylinder heads which is well-cooled by the air stream. This object is achieved by having inlet and outlet valves arranged in planes which are essentially in parallel with respect to the scavenging direction of the engine and with the valve camshaft in driving connection with the rocket arms through hollow tappets arranged in the cross-flow cylinder head.

An advantage of the invention is that the valve camshaft can be arranged at a minimum distance and next to the valve arrangement. It uses transmission elements of a small or short construction. Thus a stiff valve drive is achieved while, on the whole, the installation space is small and the arrangement is compact.

Here where the internal-combustion engine is constructed as a flat twin engine with cylinder heads which are cooled by an air stream, several outlet valves for each cylinder head may be advantageously arranged in areas which are cooled by the directly approaching air stream. Other developing possibilities of the valve arrangement are not significantly limited by the invention. For this reason, in a further development, a cross-flow cylinder head is therefore preferred which has four valves which are arranged overhead in a V-position. Here, a relatively small V-angle is preferred between the groups of identical valves for achieving a flat roof combustion chamber in the cylinder head. In addition, a centrally arranged spark plug may be provided in parallel to the cylinder axis.

In order to achieve a simple construction of a cross-flow cylinder head, a separate bearing bracket is provided as the support for the valve camshaft as well as for housing hollow tappets interacting with the shaft, so as to provide a driving connection with rocker arms which are also arranged at the bearing bracket. This bearing bracket, which is constructed as a single mounting unit, is held by means of a screwed connection with the cylinder head, the tension rods of which may also be fixed in the engine power section.

In order to reduce the overall height of the cross-flow cylinder head, a chamber is provided in the head, which is open on the cylinder-head cover side, for receiving the camshaft arranged overhead at the bearing bracket. A relatively narrow chamber is sufficient for the camshaft which is arranged at the bearing bracket in divided bearings. Further the valve camshaft may have a short construction. The short construction is promoted by an additional design of the cross-flow cylinder head, so that a driving device of the camshaft may also be housed in the chamber. Finally, it is advantageous to arrange the chamber in the area of the cylinder head which is predominantly on the engine inlet side, because stress to the enclosed valve gear caused by temperature will be reduced by the relatively cool area of the cylinder head.

The bearing bracket, which requires little installation space, for the above-described preferred 4-valve arrangement, has guides for the hollow tappets which are arranged between the parallel shafts of the rocker arms. As a result, the rocker arms have short and therefore stiff arms. These rocker arms have sliding surfaces which are constructed as cylinder surfaces to provide a perfect, low-wear and slidably movable connection with flat or slightly spherical faces of the straight hollow tappets.

Finally, within the scope of the invention, a bearing bracket is provided for a rocker shaft which is approximately in parallel to the scavenging direction and which can drive a 2-valve or 3-valve cross-flow cylinder head.

In a flat twin engine having a crankshaft pointing in the driving direction and having camshafts which are parallel to this crankshaft, the invention provides a scavenging direction which slopes down in driving direction with a preferred multiple outlet valve arrangement. The required pipe length for an exhaust system can be achieved by enclosing the cylinder partially in an actuated manner. The scavenging directions of both cylinder heads may, in addition, extend in planes which are essentially in parallel with respect to the longitudinal axis of the vehicle, or of the engine. Alternatively the planes can be sloped with respect to one another against the driving direction. As a result, the intake pipes which, according to the scavenging direction can extend in driving direction from the upward rear part of the engine toward the bottom front, may be placed advantageously with respect to sufficient leg room at the motorcycle by means of a spatially acute-angled arrangement of the scavenging device with respect to the camshaft For the construction of the valve control, the common arrangement of the valve gear and the transmission elements (rocker arms and tappets) in a common bearing bracket is also advantageous. This bearing bracket results in a stiff, complete and space-saving OHV valve control. This permits small valve angles and a central spark plug position for an optimal combustion chamber. This has a favorable effect on the internal-combustion engine with respect to its performance, torque, elasticity, and to its noise, fuel consumption and exhaust quantity. Finally, the bearing bracket results in advantages during series assembling and simplifies the cross-flow cylinder head with respect to casting and manufacturing techniques.

Other objects, advantages and novel features of the present invention will become apparent from the following detailed description of the invention when considered in conjunction with the accompanying drawings.

DETAILED DESCRIPTION OF THE DRAWINGS

Figure 1:
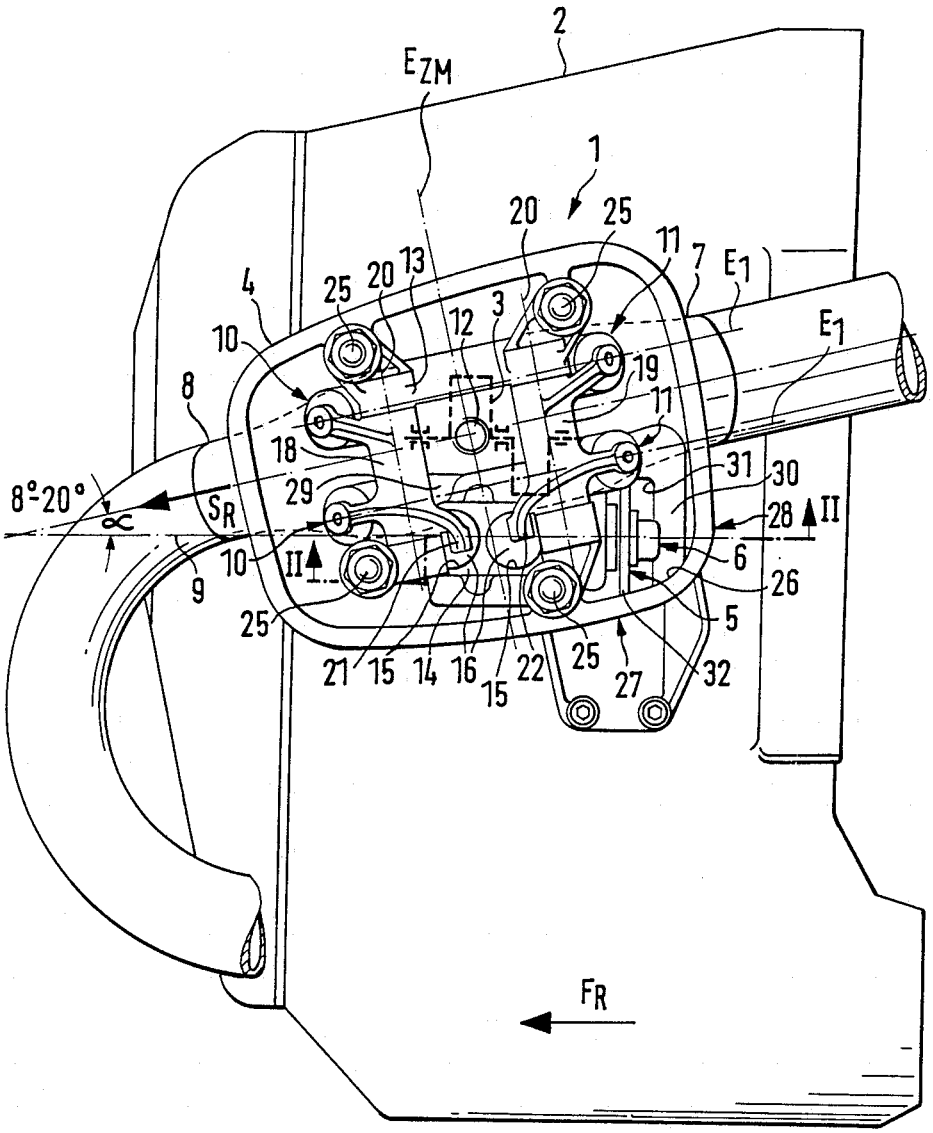
FIG. 1 is a lateral view of a flat twin engine showing a top view of a cross-flow cylinder head.

A flat twin engine 2, equipped with two cylinders 1, is arranged in a vehicle, (not shown) with its crankshaft 3 being aligned in a driving direction $F_R$. Each cylinder 1 is equipped with a cylinder head 4 constructed according to the cross-flow principle. A camshaft 6 is arranged in the cross-flow cylinder head 4, in parallel with respect to the crankshaft 3, and is driven by means of an enveloping gear 5, An inlet duct 7 on one side of the cylinder head and an outlet duct 8 on the opposite side of the cylinder head determine the flow-through or scavenging direction (arrow $S_R$) of the cross-flow cylinder head 4. As shown in FIG. 1, the cross-flow cylinder head 4 (viewed in top view) has a scavenging direction $S_R$ which extends at an acute angle of approximately 8° to 20° with respect to the axis of rotation 9 of the camshaft 6. The scavenging direction $S_R$ is directed downward toward the front with respect to the driving direction $F_R$. A pair of outlet valves 10 are arranged in the cylinder head 4, in front with respect to driving direction $F_R$, and a pair of inlet valves 11 are arranged in the rear.

The respective two outlet valves 10 and inlet valve 11 are arranged overhead in a V-position, at a relatively small V-angle in the cylinder head 4, in planes $E_1$ which are essentially parallel to the scavenging direction $S_R$. This Provides for of an optimal roof-shaped combustion chamber for the cylinder head 4 (not shown). This cylinder head 4, has a receiving space 12 for a spark plug (not shown) in the area of the combustion chamber center between the inlet valves 11 and the outlet valves 10.

Figure 2:
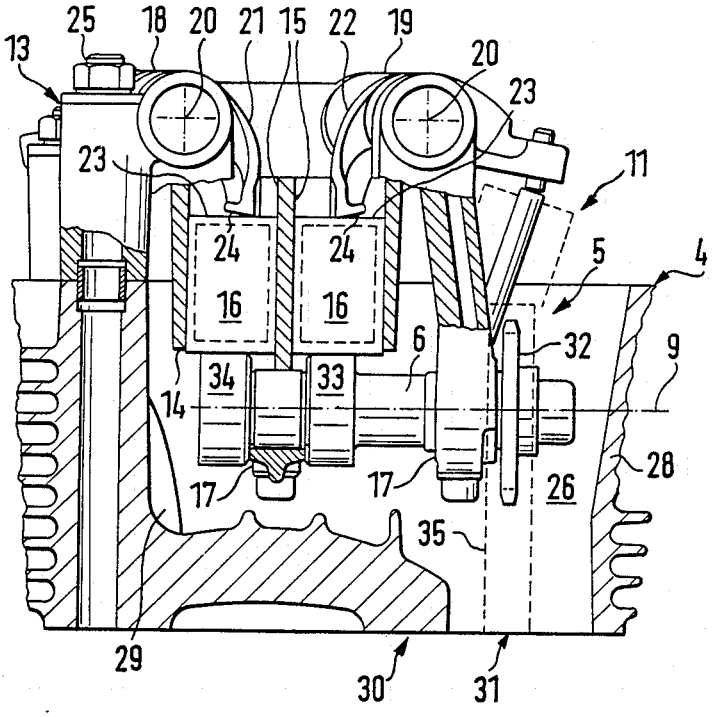
FIG. 2 is a sectional view according to Line II—II of the cylinder head with a bearing bracket placed on it for the valve control.

A bearing bracket 13, which is separate from the cross-flow cylinder head 4, has a bridge 14 aligned with the camshaft 6 and contains guides 15 for short hollow tappets 16. As shown in FIG. 2, the bottoms of the hollow tappets 16 interact with cams 33, 34 on the camshaft 6 and are supported by bearings 17 attached to the bridge 14. At the top, the hollow tappets 16 interact with rocker arms 18 and 19, which are arranged in the bearing bracket 13 so that they can be tilted around support shafts 20 which are spaced away from one another in parallel and are arranged transversely to the scavenging direction $S_R$. The outlet valves 10 are actuated by a common rocker 18 and the inlet valves 11 are actuated by a common rocker 19. The rocker arms 18 and 19 are driven by hollow tappets 16 by means of short arms 21 and 22 which arranged in the bridge 14 of the bearing block 13 between the two rocker shafts 20. On the top rocker side, the hollow tappets 16 have flat or slightly spherical faces 23. The rocker arms 21 and 22 have cylinder surfaces 24 which provide slidingly movable connection with the spherical faces 23 of the tappets 16. The axes of the cylinder surfaces 24 extend in parallel to the axis of the rocker shafts 20.

The bearing bracket 13 forms, a mounting unit with the camshaft 6, the hollow tappets 16 and the rocker arms 18 and 19. This mounting unit can be moved around the shafts 20 and is held at the cross-flow cylinder head 4 by a screwed connection 25 with the cylinder head 4.

As shown in FIG. 2, the camshaft 6 is arranged in divided bearings 17 at the bridge 14 of the bearing bracket 13. As a result, relatively large diameters are avoided for the camshaft 6, which is disposed overhead at the bearing bracket 13, or at its bridge 14. In order to keep the overall height of the cross-flow cylinder head 4 low, the cross-flow cylinder head 4 has a chamber 26 which accommodates the camshaft 6 and a significant part of the bridge 14 of the bearing bracket 13. The chamber 26 is arranged in the cylinder head 4, essentially behind the center plane $E_{ZM}$ of the cylinder and between an outer road surface side contour 27 of the cylinder head and the inlet valve 11 which is located closest to this contour. In its longitudinal dimension, the chamber 26 is essentially delimited by a cylinder head boundary 28 on the inlet side and a charge cycle duct 29 on the outlet side. In the end area of the cross-flow cylinder head 4 on the inlet side, the chamber 26 is connected with a breakthrough 31 arranged in the cylinder head bottom 30. This breakthrough 31 is penetrated by a drive chain 35 for the enveloping gear 5 which is used for driving the camshaft 6. As a result of an intermediate drive (not shown) and which is geared down 2:1, the enveloping gear 5 on the camshaft 6 may have a chain wheel 32 with a relatively small diameter. As a result of the arrangement of the enveloping gear 5 for the drive of the camshaft 6 in the relatively cool inlet area of the cross-flow cylinder head 4, it is also possible to extend the camshaft 6 beyond the cylinder head boundary 28 for an exterior enveloping gear with a toothed belt.

FIG. 2 shows that the camshaft 6, with its two spaced cams 33 and 34 ends and with the overhung cam 34 close to the outlet charge cycle duct 29. By having the bearing arrangement for the camshaft 6 at the bearing bracket 13 toward the rear of each cam 33, 34, the longitudinal dimension of the chamber 26 is kept small. In addition, a relatively large clearance is obtained for the camshaft 6 with an axis of rotation 9 of the camshaft 6 which extends at a spatially acute angle with respect to the scavenging direction $S_R$.

Figure 3:
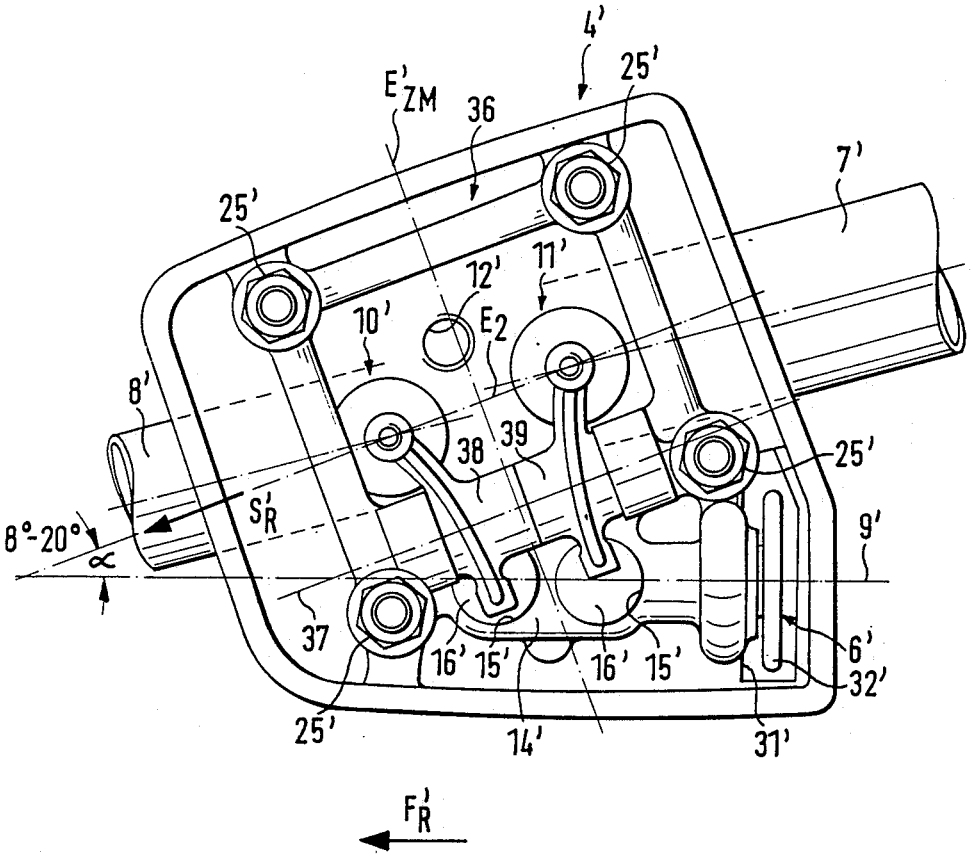
FIG. 3 is another embodiment of a bearing bracket

Within the framework of the invention according to FIG. 3, a bearing bracket 36 has a rocker shaft 37 for rocker arms 38 and 39 which is directed transversely to the cylinder center plane $E'_{ZM}$, for actuating of an inlet valve 11' and an outlet valve 10'. In this embodiment, the rocker axis 37 for a 2-valve cross-flow cylinder head 4' points approximately in the direction of the scavenging direction $S_R$.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A motorcycle internal-combustion engine having a cross-flow air-cooled single cylinder head, comprising:

a crankshaft with an axis pointing in a driving direction of the motorcycle;

a camshaft in the cross-flow cylinder head, having its rotation axis arranged essentially in parallel to the crankshaft;

the camshaft controls overhead inlet and outlet valves for engine charge cycle ducts by rocker arms;

the cross-flow cylinder head has a scavenging direction at an acute angle ($\alpha$) with the axis of rotation of the camshaft;

the inlet and outlet valves are arranged in planes, each of said planes including a respective inlet and outlet valve, said planes being essentially in parallel with respect to the scavenging direction; and wherein the camshaft is in driving connection with the rocker arms by tappets arranged in the cross-flow cylinder head.

2. An internal-combustion engine according to claim 1, wherein the scavenging direction is, as seen in top view of the cross-flow cylinder head, in a motorcycle driving direction and is sloped down toward the front of the motorcycle at an angle ($\alpha$) of between 8° and 20°.

3. An internal-combustion engine according to claim 2, wherein the cross-flow cylinder head comprises overhead inlet and outlet valves arranged in a relatively small V-angle, wherein the outlet valves are arranged toward the front driving direction and the inlet valves arranged in the rear.

4. An internal-combustion engine according to claim 3, wherein the cross-flow cylinder head is equipped with a separate bearing bracket means for supporting the rocker arms and the tappets;

wherein the bearing bracket means has a bridge aligned with the camshaft and has guide means for the tappets which are configured as short cylindrical hollow tappets, and which interact between the rocker arms and cams on the camshaft; and wherein the camshaft is arranged in bearing support at the bridge.

5. An internal-combustion engine according to claim 4, wherein the camshaft is supported by divided bearings by the bridge of the bearing bracket; wherein the bearing bracket means forms a mounting unit containing the camshaft, the hollow tappets and the rocker arms; and wherein the rocker arms are movably mounted on support shafts arranged on the mounting unit.

6. An internal-combustion engine according to claim 5, wherein the cross-flow cylinder head has a chamber located in a rear side of the cylinder head between an outer contour and an adjacent inlet valve, at a rear end of the engine, and which extends forwardly from a cylinder head boundary at the inlet side to an outlet charge cycle duct at the front end of the engine, and wherein the chamber encloses the camshaft which has the cams spaced away from one another by the bearing supported by the bridge of the bearing bracket, and wherein one of the cams is located adjacent to the outlet duct side as an overhung cam.

7. An internal-combustion engine according to claim 6, wherein the chamber is connected to a breakthrough arranged in the cylinder head bottom at an inlet-side end area of the cross-flow cylinder head, and wherein this breakthrough is penetrated by a driving device on the camshaft.

8. An internal-combustion engine according claim 1, wherein the inlet and outlet valves are arranged in a V-shape in the cross-flow cylinder head;

wherein a spark plug is arranged in an area of a cylinder center plane directed transversely with respect to the scavenging direction;

wherein a bearing bracket supports two rocker arm shafts arranged in parallel on both sides of the cylinder center plane;

wherein each rocker arm actuates several identical valves; and wherein the tappets are arranged in a bridge of the bearing bracket between the two rocker shafts.

9. An internal-combustion engine according claim 2, wherein the inlet and outlet valves are arranged in a V-shape in the cross-flow cylinder head;

wherein a spark plug is arranged in an area of a cylinder center plane directed transversely with respect to the scavenging direction;

wherein a bearing bracket supports two rocker arm shafts arranged in parallel on both sides of the cylinder center plane;

wherein each rocker arm actuates several identical valves; and wherein the tappets are arranged in a bridge of the bearing bracket between the two rocker shafts.

10. An internal-combustion engine according claim 3, wherein the inlet and outlet valves are arranged in a V-shape in the cross-flow cylinder head;

wherein a spark plug is arranged in an area of a cylinder center plane directed transversely with respect to the scavenging direction;

wherein a bearing bracket supports two rocker arm shafts arranged in parallel on both sides of the cylinder center plane;

wherein each rocker arm actuates several identical valves; and wherein the tappets are arranged in a bridge of the bearing bracket between the two rocker shafts.

11. An internal-combustion engine according claim 4, wherein the inlet and outlet valves are arranged in a V-shape in the cross-flow cylinder head;

wherein a spark plug is arranged in an area of a cylinder center plane directed transversely with respect to the scavenging direction;

wherein the bearing bracket supports two rocker arm shafts arranged in parallel on both sides of the cylinder center plane;

wherein each rocker arm actuates several identical valves; and wherein the tappets are arranged in the bridge of the bearing bracket between the two rocker shafts

12. An internal-combustion engine according to claim 8, wherein the tappets act upon cylinder surfaces on the rocker arms through slightly spherical faces; and wherein the axes of the cylinder surfaces are in parallel to the rocker shafts.

13. An internal-combustion engine according to claim 9, wherein the tappets act upon cylinder surfaces on the rocker arms through slightly spherical faces; and wherein the axes of the cylinder surfaces are in parallel to the rocker shafts

14. An internal-combustion engine according to claim 10, wherein the tappets act upon cylinder surfaces on the rocker arms through slightly spherical faces; and wherein the axes of the cylinder surfaces are in parallel to the rocker shafts.

15. An internal-combustion engine according to claim 11, wherein the tappets act upon cylinder surfaces on the rocker arms through slightly spherical faces; and wherein the axes of the cylinder surfaces are in Parallel to the rocker shafts.

16. An internal-combustion engine according to claim 1, wherein the bearing bracket is held to the cylinder head by a screwed connection.

17. An internal-combustion engine according to claim 2, wherein the bearing bracket is held to the cylinder head by a screwed connection.

18. An internal-combustion engine according to claim 1, wherein the bearing bracket has a single rocker shaft for both the inlet valve and the outlet valve and wherein said rocker arm shaft is directed transversely with respect to the cylinder center plane.

19. An internal-combustion engine according to claim 2, wherein the bearing bracket has a single rocker shaft for both the inlet valve and the outlet valve and wherein said rocker arm shaft is directed transversely with respect to the cylinder center plane.

20. An internal-combustion engine according to claim 3, wherein the bearing bracket has a single rocker shaft for both the inlet valve and the outlet valve and wherein said rocker arm shaft is directed transversely with respect to the cylinder center plane.

* * * * *